United States Patent [19]

Yan

[11] 3,998,483

[45] Dec. 21, 1976

[54] LATCH MECHANISM WITH JAMB MOUNTED LATCH BOLT

[76] Inventor: Young H. Yan, 820 Alpine St., Apt. No. 3, Los Angeles, Calif. 90012

[22] Filed: June 30, 1975

[21] Appl. No.: 591,446

[52] U.S. Cl. ..... 292/254; 292/341.15; 292/346

[51] Int. Cl.[2] ..... E05C 13/02

[58] Field of Search ..... 292/341.15, 346, 254, 292/169, 177, 178, 179, 180, 181, 182

[56] References Cited

UNITED STATES PATENTS

| | | | |
|---|---|---|---|
| 651,464 | 6/1900 | Lint | 292/254 |
| 667,297 | 2/1901 | Crawford | 292/169 |
| 1,361,317 | 12/1920 | Dulczewski et al. | 292/144 |
| 1,414,019 | 4/1922 | Hjort | 292/169 |
| 2,238,066 | 4/1941 | Mantz | 292/254 |
| 2,366,847 | 1/1945 | Fendring | 292/254 |
| 3,606,429 | 9/1971 | Palmer | 292/346 |

*Primary Examiner*—Paul R. Gilliam
*Assistant Examiner*—Kenneth J. Dorner
*Attorney, Agent, or Firm*—William P. Green

[57] ABSTRACT

A door latch mechanism including a latch bolt to be movably carried by the jamb of the door and yieldingly urged to an active position, and a keeper carried by the door and constructed to deflect the latch bolt during closing movement of the door, with a retracting part also being carried by the door and operable to engage and retract the jamb-carried latch bolt to free the door for opening movement.

5 Claims, 18 Drawing Figures

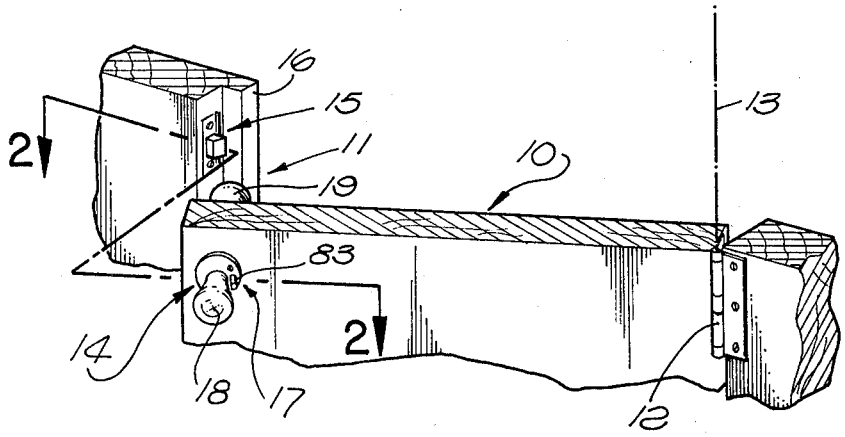
FIG. 1.
FIG. 2.
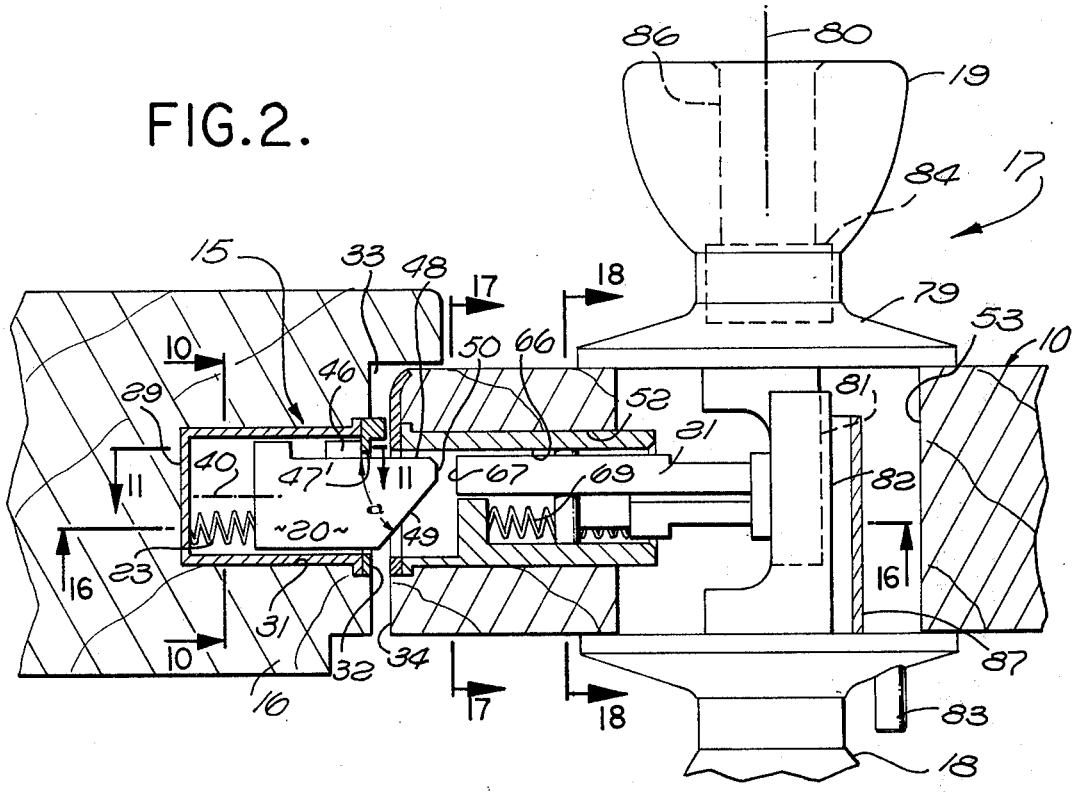
FIG. 3.
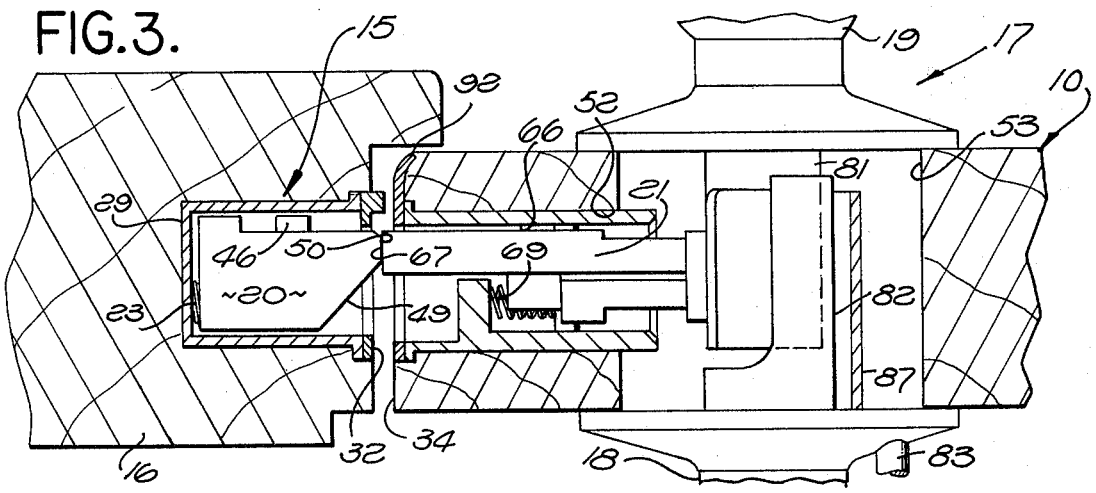

LATCH MECHANISM WITH JAMB MOUNTED LATCH BOLT

BACKGROUND OF THE INVENTION

This invention relates to improved latch mechanisms for releasably holding a door or the like in closed condition. The invention is in certain respects especially effective for use in conjunction with swinging doors, and to simplify this disclosure will be described and shown as applied to that use but without limiting the scope of the claims to preclude coverage of the mechanism when employed for latching other types of moveable members for which the mechanism may be adapted.

The conventional type of door lock employed in the construction industry includes a spring urged latch bolt which is moveably carried by the door, and is adapted to engage and be deflected by, and co-act in holding relation with, a keeper carried by an adjacent jamb. Knobs carried by the door release the latch bolt to permit opening of the door, and may be controlled by a key operated lock unit preventing such release of the bolt.

One difficulty which has been encountered with such prior conventional door locks has been the relative ease with which an unauthorized person can, from the outside of the door, move the latch bolt to the retracted position without use of a key. More specifically it is relatively easy with most of these prior locks to insert a thin element such as a knife blade, credit card or any of numerous other similar items which may be readily available, into the narrow space between the edge of the door and the adjacent jamb in a manner contacting the inclined cam or wedge face at the outer side of the latch bolt and exerting force there against to deflect the bolt to its retracted position permitting opening of the door. Because the cam face of the latch bolt is at the side of the bolt facing toward the outside of the door any appropriate instrument inserted between the door and jamb can easily contact that surface and deflect it to a retracted position with little or no skill required.

Various expedients have been devised in the past for attempting to prevent such unwanted retraction of a latch bolt of the above discussed type. For example, in some locks currently on the market a second spring pressed element is provided adjacent the latch bolt proper, and is deflected by the keeper, when the door is closed, to a position in which it is intended to block such retraction of the bolt by other than the key actuated unit. However, the prior devices of this type of which I am aware are not as affective as would be desired, and can usually be defeated with only very little more manipulation than when the second spring pressed element is not present. An unauthorized person can still exert retracting force against the cam face of the latch bolt by a thin card or element as discussed, and in most cases release it for retraction by jiggling the door while such force is applied.

SUMMARY OF THE INVENTION

The present invention overcomes these inadequacies of the conventional type of door lock by providing a novel latch mechanism in which the latch bolt is moveably carried by the door jamb rather than the door itself and a co-acting keeper or strike unit is carried by the door, in conjunction with a retracting part which is also carried by the door and is adapted to be manually actuated in a manner retracting and thereby releasing the latch bolt to permit opening movement of the door. The retracting part is actuable by a knob or other operating handle carried by the door, with movement of that knob or other handle preferably being controlled by a key actuated lock unit. The retracting part may be a sliding element which in the closed condition of the door is located directly opposite the latch bolt, and is slidably moveable toward the latch bolt to push it to a retracted position and out of holding engagement with the keeper. Such movement of both the latch bolt and retracting part may be yieldingly resisted, desirably by two springs associated with these two parts respectively.

The latch bolt may have an inclined camming surface which is engaged and deflected by the keeper during closing movement of the door. This camming surface, however, is desirably so located as to not be easily accessible to a person attempting to open the door without authorization. For this purpose, the cam surface should preferably be located at a side of the latch bolt facing generally toward the inside of the doorway, that is, facing in a direction away from the side at which the person attempting unauthorized entry will be located. As a result, the bolt cannot be retracted merely by insertion of a knife blade, card, or the like into the space between the door and door jamb. In addition, the jamb carried mechanism preferably also includes a blocking projection extending outwardly at a location beyond the latch bolt and in the direction of closing movement of the door, to block movement past that location of any special hook shaped tool or element by which an intruder may attempt to reach about the latch bolt to its back side to engage and exert retracting force against its camming face.

BRIEF DESCRIPTION OF THE DRAWINGS

The above and other features and objects of the invention will be better understood from the following detailed description of the typical embodiments illustrated in the accompanying drawings, in which:

FIG. 1 is a fragmentary perspective representation of a swinging door having a lock constructed in accordance with the invention;

FIG. 2 is an enlarged fragmentary horizontal section taken in the plane 2—2 of FIG. 1, but showing the lock mechanism as it appears when the door is closed;

FIG. 3 is a view similar to FIG. 2 but showing the latch bolt as it appears when retracted to permit opening of the door;

DESCRIPTION OF THE PREFERRED EMBODIMENT

Figure 4:
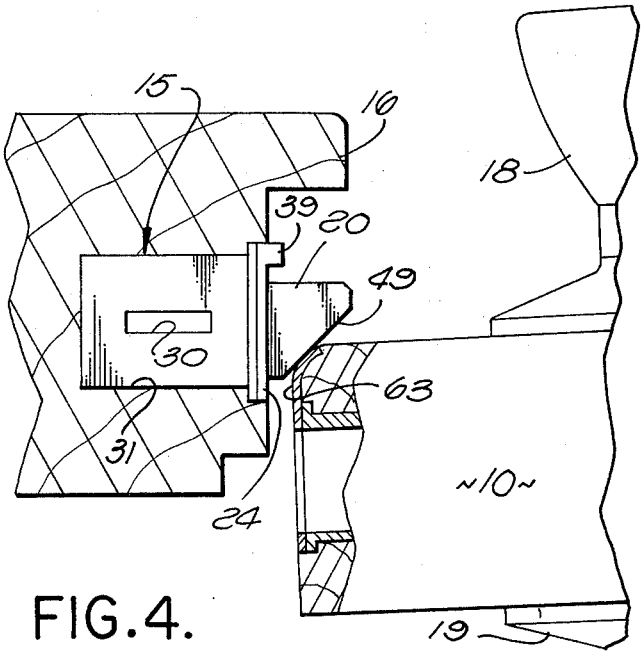
FIG. 4 is a view similar to FIGS. 2 and 3, but showing the door during closing movement.
Figure 5:
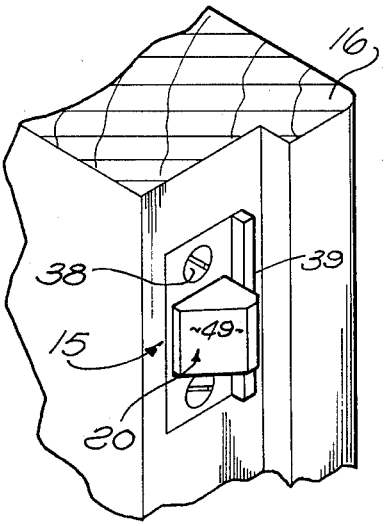
FIG. 5 is a perspective view of the external appearance of the latch assembly carried by the door jamb.

Referring first to FIG. 1, I have represented fragmentarily at 10 a door which is mounted within a typically vertical doorway 11 by hinges 12 for swinging movement about a vertical axis 13 in opening and closing directions. A lock mechanism 14 is adapted to retain the door in closed position and includes a latch assembly 15 carried by the vertical jamb 16 defining one side of the doorway, and a door carried second assembly 17 actuable by two inner and outer knobs 18 and 19. As seen in FIGS. 2, 3, and 4, assembly 15 carried by the jamb includes a spring pressed latch bolt 20 moveable between the positions of FIGS. 2 and 3, while the assembly 17 carried by the door includes a slide part 21 which is adapted to retract the bolt to the FIG. 3 position.

Figure 6:
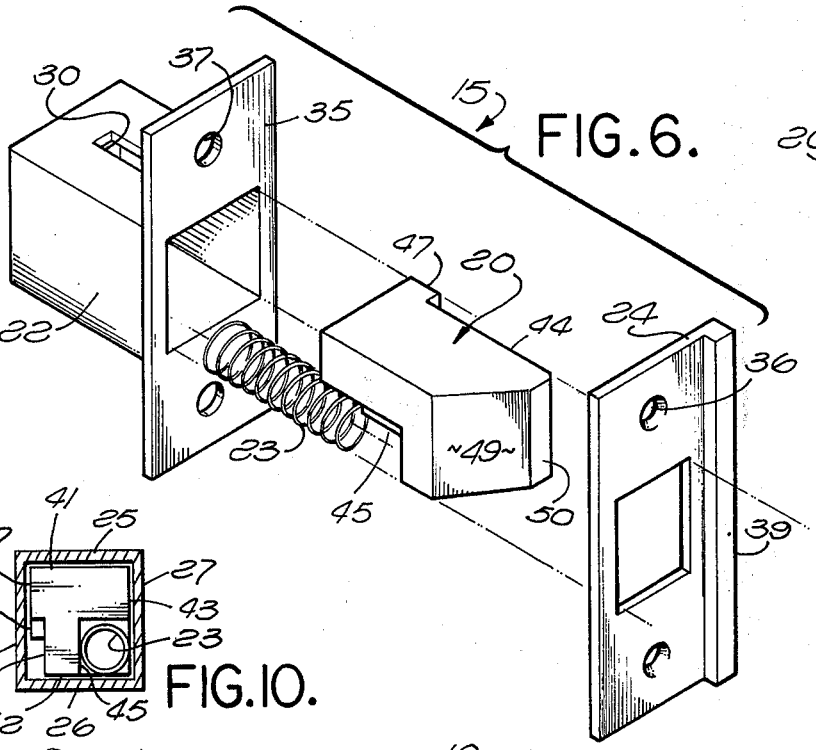
FIG. 6 is an exploded perspective representation of the latch assembly of FIG. 5.
Figure 7:
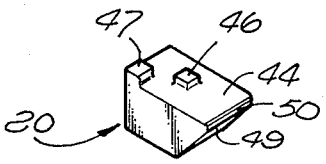
FIGS. 7,8, and 9 are detailed perspective views showing the latch bolt as it appears from different angles.
Figure 8:
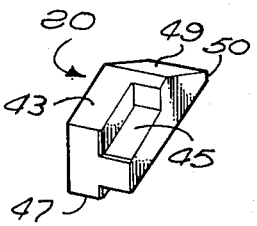
Figure 9:
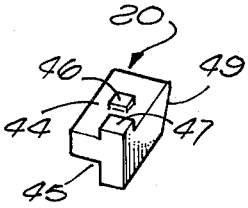

FIG. 6 shows in exploded perspective the various elements of the jamb carried assembly 15, including the latch bolt 20, a housing 22 moveably containing the bolt, a spring 23 urging the bolt to its outwardly projecting position of FIG. 2, and a plate 24 disposed across the front side of the housing. The housing may be of rectangular configuration, as shown, having horizontal top and bottom walls 25 and 26 (FIG. 10), vertical side walls 27 and 28, and an inner vertical wall 29, one or more of which walls may contain vent openings 30 (FIG. 6) for venting air into and out of the housing behind bolt 20 to avoid resistance by compressed air to movement of the bolt. The housing is received within a recess 31 in jamb 16, with plate 24 at the forward side of the housing having its outer planar surface 32 disposed in the plane of jamb surface 33 which faces and is parallel to edge surface 34 of the door. Plate 24 may be rectangular and dimensioned in correspondence with an outer rectangular flange 35 carried by housing 22, and is suitably secured to flange 35 is fixed relation thereto, as by providing plate 24 with rearwardly extending tubular rivet portions 36 which extend through openings 37 in flange 35 and are deformed to enlarged diameter conditions beyond those openings to hold the two plates 24 and 35 together. The passages through rivets 36 then define openings through which screws 38 may extend to secure assembly 15 to the jamb. Extending along its outer edge (that is, the edge nearest the outside of doorway 11), plate 24 has a vertical projection or rib 39, which projects a substantial distance beyond the plane of jamb surface 33 and plate surface 32 and toward the edge 34 of the door, to essentially close the gap at that location between the door and jamb in a relation blocking unwanted insertion through that gap of a hook shaped or other tool which might be used to engage and retract bolt 20.

The latch bolt 20 is shaped to fit relatively closely within housing 22, in a relation guiding the latch bolt for movement only along a predetermined horizontal axis 40 (FIG. 2) which is perpendicular to edge surface 34 of the door.

Figure 10:
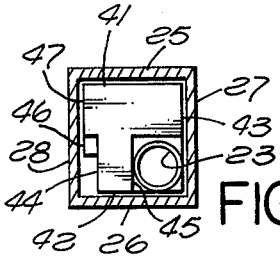
FIGS. 10 and 11 are fragmentary sections taken on lines 10—10 and 11—11 of FIG. 2.
Figure 17:
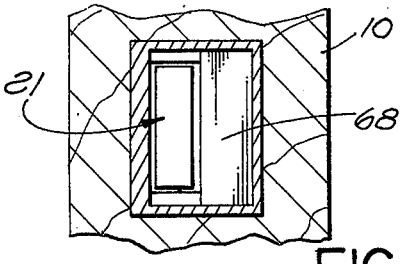
FIGS. 16, 17, and 18 are sections taken on lines 16—16, 17—17 and 18—18 respectively of FIG. 2.
Figure 18:
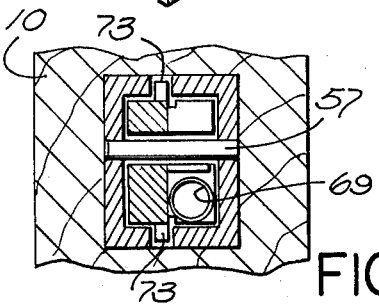
Figure 11:
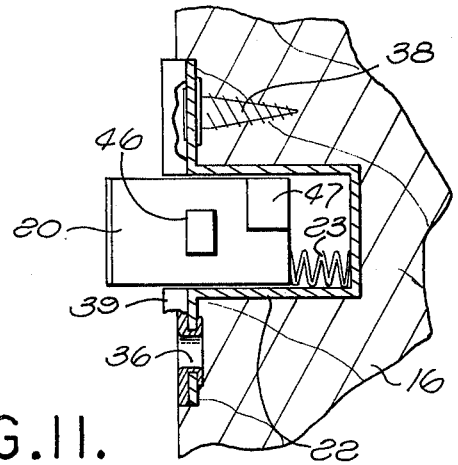
Figure 12:
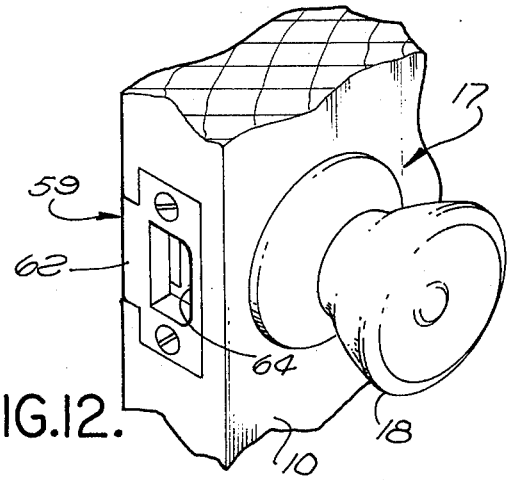
FIG. 12 is a perspective view showing the external appearance of the door carried keeper structure.

As will be apparent from FIG. 10, the latch bolt may be of essentially rectangular section transversely of axis 40, having planar top and bottom surfaces 41 and 42 and planar vertical side surfaces 43 and 44, with a rectangular recess 45 being formed in the back side of the bolt to partially receive coil spring 23 so that the spring exerts axial force in opposite directions against the housing and bolt to yieldingly urge the bolt to its outwardly projecting position of FIG. 2. At one of its sides, the bolt may have two projections 46 and 47 which project into close proximity to a side wall 28 of housing 22. The forward one of these projections 46 is engageable against the back side of plate 24 in the FIG. 2 position of the latch bolt to limit the spring urged movement of the bolt and determine the extend of projection of the bolt from the plate through a rectangular opening 47′ in the plate. The portion of the bolt which projects outwardly beyond the plate in that FIG. 2 position is defined at one side by a planar vertical surface 48 disposed parallel to axis 40, and at its opposite side by an inclined camming surface 49 disposed at a camming angle *a* with respect to axis 40. A vertical nose surface 50 may be formed at the outer end of the bolt, with the top and bottom of the projecting portion of the bolt being defined by the previously mentioned planar horizontal surfaces 41 and 42.

Figure 13:
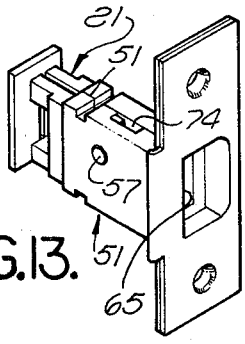
FIG. 13 is a perspective view of a portion of the door carried mechanism.

The assembly 17 which is carried by the swinging door includes a housing 51 (FIG. 13), which moveably contains the latch bolt retracting part 21, and which is mounted within an appropriately shaped recess 52 cut into the door from its edge surface. A communicating recess 53 extending through the door enables mounting of knobs 18 and 19 in essentially conventional manner and in a relation to operate bolt retracting part 21.

Figure 14:
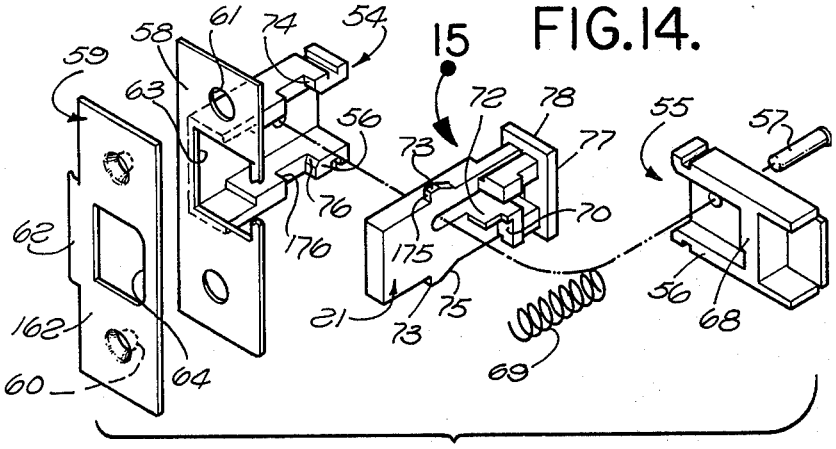
FIG. 14 is an exploded perspective representation of the door carried mechanism.
Figure 15:
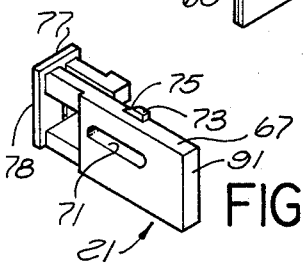
FIG. 15 is a perspective view of the latch bolt retracting part.

The housing 51 may be formed of two complementary parts 54 and 55 (FIG. 14), which meet at a plane 56, and are secured rigidly together in appropriate manner as by a rivet 57 extending through aligned openings in the two parts. The first housing part 54 carries a planar flange 58 at its outer end, to which a keeper or strike plate 59 is rigidly secured, as by providing plate 59 with rivet portions 60 extending through openings 61 in flange 58 and flared at their inner ends to secure the plates 58 and 59 tightly together. Plate 59 is planar except at the location of an outer angularly disposed camming tab 62, with the outer planar surface 162 of plate 59 being disposed perpendicular to axis 40 in the FIG. 2 position of the mechanism, and lying in the plane of edge surface 34 of the door. Plates 58 and 59 contain openings 63 and 64 through which bolt 20 projects in the latched condition of the mechanism. In that condition, the flat surface 48 of the bolt engages vertical edge 65 of opening 64 in plate 59 to positively block opening movement of the door.

The retracting part or slide 21 is confined closely within a guideway 66 in housing 51, in a relation guiding part 21 for only sliding movement along axis 40 of FIG. 2. Upon such movement, a rectangular end portion 67 of slide 21 is moveable from the FIG. 2 position to the FIG. 3 position, to retract latch 20 to its door releasing position of FIG. 3. Portion 67 of the slide occupies only a portion of the transverse extent of the guideway 66 in housing 51, with the remainder of that cross section at one location being occupied by a transverse wall portion 68 (FIGS. 2 and 14) of section 55 of the housing. This wall 68 is located sufficiently far to the right of the plane of plate 59 in FIG. 2 to define a socket recess within which the end of bolt 20 is receivable in the latched condition of FIG. 2. At its inner or rear side, wall 68 engages a coil spring 69, whose opposite end bears against a transverse shoulder 70 (FIG. 14) formed on retracting slide 21 to yieldingly retract that slide part to its FIG. 2 position. An elongated slot 71 formed in retracting part 21 allows extension of rivet 57 through that slide without interfering with axial movement thereof. A wall 72 formed on retracting part 21 confines the engaged end of spring 69 against movement toward slot 71, and a recess 169 in wall 68 receives and locates the opposite end of spring 69. The axial movement of part 21 is limited by provision of a pair of ears or lugs 73 formed at the top and bottom of part 21, and slidably received within slots 74 formed in the top and bottom walls of housing section 54. More specifically, movement of part 21 in a rightward direction as viewed in FIG. 2 is limited by engagement of preferably inclined wedging surfaces 75 formed on lugs 73 with correspondingly inclined wedging surfaces 76 formed at the inner ends of slots 74, while movement of part 21 in a leftward direction is limited at the FIG. 3 position by engagement of surface 175 on the lugs with end surface 176 of the slots (see FIG. 14). At its inner end, slide 21 may have a plate or flange portion 77 disposed transversely of axis 40 and having a planar transverse end surface against which force is exerted to move part 21 to the left as seen in FIG. 3.

Figure 16:
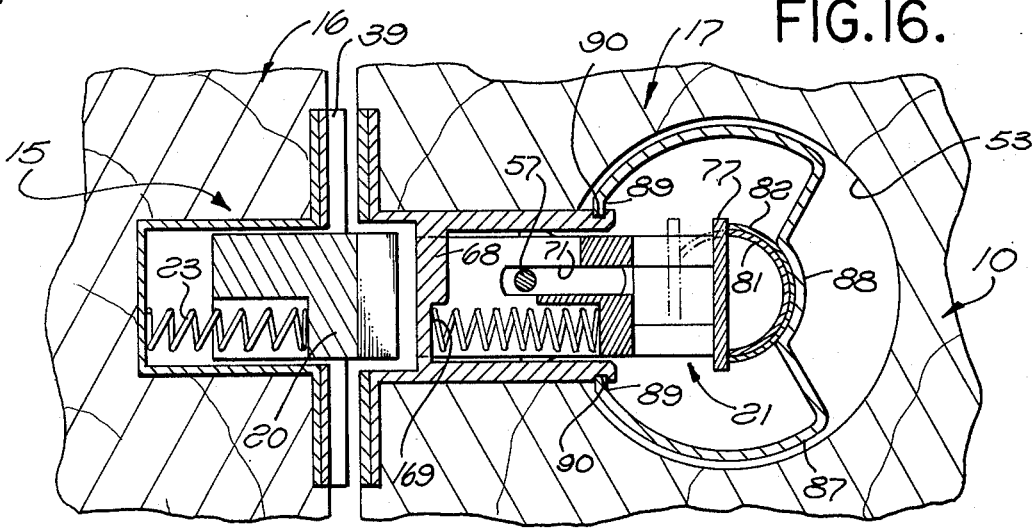

Each of the knobs 18 and 19 is mounted in conventional manner by a mounting structure represented generally at 79, to be manually turned about an axis 80 which is perpendicular to the previously discussed axis 40. At its inner end, knob 19 has an arcuate portion 81 (FIGS. 2 and 26), which is adapted to be turned by the knob about axis 80 and when so turned to act against flange 77 in a relation actuating retracting part 21 from the FIG. 2 position to the FIG. 3 position. Similarly, knob 18 has an arcuate portion 82 which that knob turns about axis 80 to actuate part 21 to its FIG. 3 position. A manually actuated control element 83 is operable to lock a conventional holding mechanism represented diagrammatically at 84 in FIG. 2, in a relation locking knob 19 against turning movement. This control element is typically illustrated as a known type of push button 83 located adjacent knob 18 and adapted to lock knob 19 when element 83 is pressed axially inwardly. However, element 83 may alternatively be any other known type of control element, such as for example a push button or rotary element mounted in the center of knob 18. Mechanism 84 may be released by actuation of a conventional key controlled lock unit 86, typically mounted within the center of knob 19 and accessible for key actuation at the center of that knob. Since all of this knob and key controlled mechanism may take any of different very well known and conventional forms, no attempt has been made in the drawings to illustrate any particular mechanism in detail. It may be noted, however, that in order to assure and maintain proper relationship between the knobs and the mechanism controlled thereby, there may be attached to one of the knob mounting units 79 a stationary structure represented at 87 in FIGS. 2 and 16, projecting into recess 53 of the door and having an arcuate portion 88 which backs up and locates slide actuating portions 81 and 82. The structure 87 may also have two spaced portions 89 which are received within upper and lower grooves 90 in housing 51 to locate that housing relative to the knob mechanism. During assembly of the parts, element 87 may be moved in a direction parallel to axis 80 to slidably interfit with grooves 90 of housing 51.

To now describe the operation of the discussed latch mechanism, assume that the door is initially in the closed condition of FIG. 2 in which latch bolt 20 retains the door against opening movement (downward movement of the door as view in FIG. 2). Assume also that mechanism 84 has been set by actuation of push button 83 to a locked condition, in which it prevents turning movement of outer knob 19. If an unauthorized person then attempts to enter the door from its outer side (the side located at the top of FIG. 2), he cannot turn knob 19 and therefore is precluded from entering. Further, if he attempts to insert a knife blade, credit card, or the like into the space between surfaces 33 and 34 at the jamb and door, from the side of the door at which knob 19 is located, he cannot possibly push the edge of that element against camming surface 49 of the latch bolt in the manner in which the door carried latch bolts of conventional mechanisms can be actuated. This is true because cam surface 49 is located at the inner side of the latch bolt, that is, the side facing away from the position from which the unauthorized person is attempting to release the bolt. The only way he might attempt to force the bolt to its retracted FIG. 3 position is by utilizing some type of special instrument having a hook shape to reach about and behind the latch bolt and engage its rear cam face. This type of actuation, however, is difficult, requires a special instrument, and in addition is precluded or rendered more difficult by provision of the blocking projection 39 at the outer edge of plate 32 of the latch mechanism. The entire assembly is thus much more difficult to defeat than is a conventional door lock.

Authorized persons unlock the door by insertion of a key within unit 86 at the outside of the door, with the key serving when turned relative to the knob to turn arcuate projection 81 associated with the knob (see broken line position of FIG. 16), in a relation pushing slide 21 leftwardly from its FIG. 2 position to its FIG. 3 position, to thus actuate latch bolt 20 to a retracted position slightly beyond the plane of the outer surface of strike plate 62, so that the door may be pushed open and the latch bolt 20 will slide from the outer surface 91 of part 21 onto the outer surface of plate 59 and across that surface to its edge 92. When the door is subsequently closed the angularly disposed camming portion 62 of plate 59 engages camming surface 49 of latch bolt 20 as seen in FIG. 4 to deflect that latch bolt progressively leftwardly far enough to enable the keeper or strike plate 59 to move past the latch bolt until the spring pressed bolt can fall into opening 64 in plate 59 to the latched position of FIG. 2. When the key controlled mechanisms 84 and 86 are not locked, either of the knobs 18 or 19 may be turned freely, and when so turned in either direction will actuate part 21 to retract bolt 20 and permit opening of the door.

While a certain specific embodiment of the present invention has been disclosed as typical, the invention is of course not limited to this particular form, but rather is applicable broadly to all such variations as fall within the scope of the appended claims.

I claim:

1. A latch mechanism comprising a first assembly to be mounted to a jamb; and a second assembly to be mounted to a member which swings relative to the jamb between open and closed positions, with said second assembly being received opposite said first assembly in closed position of said member;

said first assembly including a latch bolt mounted for sliding movement along a predetermined axis toward and away from said second assembly and between active and retracted positions and yieldingly urged to said active position, said latch bolt having a peak portion with a latching surface at one side thereof and a camming surface at its opposite side inclined with respect to said axis;

said second assembly including a keeper structure having a portion adapted to engage said camming surface and deflect said latch bolt from said active position toward said retracted position upon closing movement of said member, and to then release said latch bolt for return to said active position to retain said member in closed position;

said second assembly including a housing, a retracting part which is mounted by said housing for sliding movement in a direction to move essentially along said axis when said member is in its closed position, and manually operated means for sliding said retracting part axially toward said bolt to retract it;

said retracting part having an end portion which is narrower than said latch bolt in the direction of closing movement of said member, and which is located axially opposite said peak portion of the latch bolt in said closed position of said member and is engageable with said peak portion upon axial sliding movement of said part to push the bolt axially from said active position thereof toward said retracted position and thereby free said member for opening movement;

said housing having a wall which is laterally adjacent said end portion of said retracting part, and which in said closed position of said member is axially opposite said camming surface of the bolt, and which defines a side of a passage narrower than said bolt, in the direction of closing movement of said member, through which said end portion of the retracting part projects axially past said wall to engage and act against said peak portion of said bolt;

said second assembly including a spring yieldingly resisting sliding movement of said retracting part in a bolt retracting direction;

said retracting part having a widened portion which is wider than said end portion and is located axially beyond said wall in a direction away from said latch part;

said spring being a coil spring located entirely at one side of said end portion of the retracting part and located axially opposite said camming surface of the latch bolt in the closed position of said member, and acting in opposite directions against said wall and said widened portion of the retracting part to urge the latter to an inactive position thereof;

said housing including two complementary sections meeting in a predetermined plane and one of which slidably contains said end portion of the retracting element, the other of said sections carrying said wall and a part of said widened portion of said retracting part and said spring;

said second assembly including a pin connected at opposite ends to said two housing sections;

said retracting part containing an elongated slot through which said pin extends; and said second assembly including at least one lug projecting from said retracting part into a coacting recess formed in said one section of the housing adjacent said plane.

2. A latch mechanism as recited in claim 1, in which said manually actuated means include a handle accessible from an outer side of said member for actuating said retracting part to retract said latch bolt, and a key operated lock for releasably locking said handle against latch bolt retracting movement.

3. A latch mechanism as recited in claim 1, in which there are two of said lugs projecting from said retracting part into two of said coacting recesses in said one section adjacent said plane.

4. A latch mechanism comprising:

a first assembly to be mounted to a jamb; and a second assembly to be mounted to a member which swings relative to the jamb between open and closed positions, with said second assembly being received opposite said first assembly in closed position of said member;

said first assembly including a latch bolt mounted for sliding movement along a perdetermined axis toward and away from said second assembly and between active and retracted positions and yieldingly urged to said active position, said latch bolt having a peak portion with a latching surface at one side thereof and a camming surface at its opposite side inclined with respect to said axis;

said second assembly including a keeper structure having a portion adapted to engage said camming surface and deflect said latch bolt from said active position toward said retracted position upon closing movement of said member, and to then release said latch bolt for return to said active position to retain said member in closed position;

said second assembly including a housing, a retracting part which is mounted by said housing for sliding movement in a direction to move essentially along said axis when said member is in its closed position, and manually operated means for sliding said retracting part axially toward said bolt to retract it;

said retracting part having an end portion which is narrower than said latch bolt in the direction of closing movement of said member, and which is located axially opposite said peak portion of the latch bolt in said closed position of said member and is engageable with said peak portion upon axial sliding movement of said part to push the bolt axially from said active position thereof toward said retracted position and thereby free said member for opening movement;

said housing having a wall which is laterally adjacent said end portion of said retracting part, and which is said closed position of said member is axially opposite said camming surface of the bolt, and which defines a side of a passage narrower than said bolt, in the direction of closing movement of said member, through which said end portion of the retracting part projects axially past said wall to engage and act against said peak portion of said bolt;

said second assembly including a spring yieldingly resisting sliding movement of said retracting part in a bolt retracting direction;

said retracting part having a widened portion which is wider than said end portion and is located axially beyond said wall in a direction away from said latch part;

said spring being a coil spring located entirely at one side of said end portion of the retracting part and located axially opposite said camming surface of the latch bolt in the closed position of said member, and acting in opposite directions against said wall and said widened portion of the retracting part to urge the latter to an inactive position thereof;

said housing including two complementary sections meeting in a predetermined plane and one of which slidably contains said end portion of the retracting element, the other of said sections carrying said wall and a part of said widened portion of said retracting part and said spring;

said second assembly including at least one lug projecting from said retracting part into a coating recess formed in said one section of the housing adjacent said plane.

5. A latch mechanism comprising:

a first assembly to be mounted to a jamb; and a second assembly to be mounted to a member which swings relative to the jamb between open and closed positions, with said second assembly being received opposite said first assembly in closed position of said member;

said first assembly including a latch bolt mounted for sliding movement along a predetermined axis toward and away from said second assembly and between active and retracted positions and yieldingly urged to said active position, said latch bolt having a peak portion with a latching surface at one side thereof and a camming surface at its opposite side inclined with respect to said axis;

said second assembly including a keeper structure having a portion adapted to engage said camming surface and deflect said latch bolt from said active position toward said retracted position upon closing movement of said member, and to then release said latch bolt for return to said active position to retain said member in closed position;

said second assembly including a housing, a retracting part which is mounted by said housing for sliding movement in a direction to move essentially along said axis when said member is in its closed position, and manually operated means for sliding said retracting part axially toward said bolt to retract it;

said retracting part having an end portion which is narrower than said latch bolt in the direction of closing movement of said member, and which is located axially opposite said peak portion of the latch bolt in said closed position of said member and is engageable with said peak portion upon axial sliding movement of said part to push the bolt axially from said active position thereof toward said retracted position and thereby free said member for opening movement;

said housing having a wall which is laterally adjacent said end portion of said retracting part, and which in said closed position of said member is axially opposite said camming surface of the bolt, and which defines a side of a passage narrower than said bolt, in the direction of closing movement of said member, through which said end portion of the retracting part projects axially past said wall to engage and act against said peak portion of said bolt;

said second assembly including a spring yieldingly resisting sliding movement of said retracting part in a bolt retracting direction;

said retracting part having a widened portion which is wider than said end portion and is located axially beyond said wall in a direction away from said latch part;

said spring being a coil spring located entirely at one side of said end portion of the retracting part and located axially opposite said camming surface of the bolt in the closed position of said member, and acting in opposite directions against said wall and said widened portion of the retracting part to urge the latter to an inactive position thereof;

said housing including two complementary sections meeting in a predetermined plane and one of which slidably contains said end portion of the retracting element, the other of said sections carrying said wall and a part of said widened portion of said retracting part and said spring;

said second assembly including a pin connected at opposite ends to said two housing sections;

said retracting part containing an elongated slot through which said pin extends.

* * * * *